US005419023A

United States Patent [19]

Hawkins et al.

[11] Patent Number: 5,419,023

[45] Date of Patent: May 30, 1995

[54] APPARATUS FOR CRIMPING TOW AND APPLICATION OF FINISH TO THE TOW

[75] Inventors: Roland L. Hawkins, Spartanburg, S.C.; Lotfy L. Saleh, Charlotte, N.C.

[73] Assignee: Hoechst Celanese Corporation, Somerville, N.J.

[21] Appl. No.: 294,893

[22] Filed: Aug. 23, 1994

Related U.S. Application Data

[63] Continuation of Ser. No. 170,439, Dec. 20, 1993, abandoned, which is a continuation of Ser. No. 922,702, Jul. 30, 1992, abandoned.

[51] Int. Cl.[6] ..... D02G 1/12

[52] U.S. Cl. ..... 28/267; 28/263; 28/221

[58] Field of Search ..... 28/266, 267, 221, 255, 28/281, 258, 262, 263, 265; 68/5 R, 5 C, 62, 177, 178; 8/152

[56] References Cited

U.S. PATENT DOCUMENTS

| | | | |
|---|---|---|---|
| 2,311,174 | 2/1943 | Hitt . | |
| 2,575,781 | 11/1951 | Barach | 28/267 |
| 2,575,838 | 11/1951 | Rainard | 28/267 |
| 2,854,728 | 10/1958 | Rainard | 28/267 |
| 3,305,897 | 2/1967 | Meibohm . | |
| 3,636,149 | 1/1972 | Tambini . | |
| 3,643,298 | 2/1972 | Schmick . | |
| 3,751,778 | 8/1973 | Grosjean et al. | 28/267 |
| 3,810,285 | 5/1974 | Ferrler et al. | 28/267 |
| 3,813,740 | 6/1974 | Heijnis . | |
| 3,911,539 | 10/1975 | Hughes et al. . | |
| 3,916,651 | 11/1975 | Carruthers | 28/267 |
| 4,040,153 | 8/1977 | Hatcher et al. | 28/267 |
| 4,075,743 | 2/1978 | Roberts . | |
| 4,122,019 | 10/1978 | Hughes . | |
| 4,158,298 | 6/1979 | Bähre | 28/267 |
| 4,268,940 | 5/1981 | Kuroda et al. | 28/267 |
| 4,642,860 | 2/1987 | Saleh et al. . | |
| 5,023,130 | 6/1991 | Simpson . | |

*Primary Examiner*—Clifford D. Crowder
*Assistant Examiner*—Larry D. Worrell, Jr.
*Attorney, Agent, or Firm*—T. C. Doyle

[57] ABSTRACT

An apparatus for crimping continuous tow of textile material and application of the finish to the crimped continuous tow, including a pair of rollers and a stuffer box chamber having two regions therein. In particular, the stuffer box chamber has a first region for crimping the tow and a larger second region for application of a finish to the tow. Using the novel apparatus to crimp the tow and apply finish thereto, improves adherence of the finish to the tow.

17 Claims, 1 Drawing Sheet

APPARATUS FOR CRIMPING TOW AND APPLICATION OF FINISH TO THE TOW

This is a continuation of application Ser. No. 08/170,439 filed on Dec. 20, 1993, now abandoned which is a continuation of U.S. Pat. No. 07/922,702 filed on Jul. 30, 1992, now abandoned.

BACKGROUND OF THE INVENTION

1. Field of the Invention

The present invention relates to the preparation of crimped tow using a stuffer box in combination with a pair of crimping rollers to feed molded tow to the stuffer box. The stuffer box includes an initial first region adjacent to the rollers for crimping, and a second region for application of finish. The application of finish subsequent to the crimping process improves the crimping of the fiber as well as adherence of the finish to the fiber.

2. Prior Art

In prior art apparatuses, continuous filament tow is typically pulled, dewatered, rectangularly molded and fed by a single pair of smooth cylindrical parallel rotatable crimping rollers in conjunction with side plates, into a rectangular stuffer box referred to in some references as a crimping chamber. The stuffer box generally forms a substantially rectangular closed pressure zone having a weighted discharge flapper at the exit thereof. As the tow is fed by the crimping rollers into the stuffer box, the filaments bend back and forth upon itself and against the resistance of the inner walls of the stuffer box, forming a crimped wad. This wad is compressed in its passage through the stuffer box by the friction of the sidewalls and the weighted discharge flapper. The action of the crimping rollers in continuously feeding tow into the chamber produces crimps in the tow, which can be later effectively set by heat or fluid treatment. Or in the alternative, the crimp can be set by the introduction of steam into the chamber. The crimped tow is discharged from the stuffer box at a rate proportionate to the infeed of the crimping rollers.

Optimally, crimped tow material is produced when resistance to the rectangularly molded tow by walls of the stuffer box is evenly distributed. One factor in achieving even resistance is by having uniform finish on the fiber. Some applications of finish require a slick finish to be applied, which diminishes the resistance of the fiber within the stuffer box.

The following references are directed to various apparatuses used for crimping filament or fiber tow, that include at least a stuffer box and crimping rollers. U.S. Pat. No. 3,911,539 to Hughes et al, discloses a method and apparatus for crimping tow incorporating the injection of steam in various regions within the stuffer box to set the crimp in the tow. In particular, the stuffer box has three various regions into which various pressures of steam are injected to acquire superior crimp products. Also, it is noted within the disclosure, that finish may be applied to the fibers through spinning and/or drawing steps, and/or also prior to the crimping.

Other references directed to improving the crimping through the injection of steam, include U.S. Pat. Nos. 3,643,298; 3,305,897, and 4,122,019. Also known as prior art is the inclusion of holes in the stuffer box downstream of the steam injection ports wherein the holes allow for escape of the steam to control pressure buildup in the stuffer box. Also, it is known that finish can be injected through the steam injection ports.

Application of a slick finish prior to the crimping apparatus has been found to increase the difficulty in crimping the tow due to the slickness of the tow. Also, the application of finish to the tow through the steam injection ports has been found to be unsatisfactory based on the distribution of the finish on the tow and crimping of the tow. The problem addressed by the present invention is uniform crimping of slick finished tow.

The foregoing prior art fails to address the issue of the application of finish to the tow subsequent to the crimping of the tow. There remains a need to develop an apparatus for the stuffer box crimping that will not only improve the crimping of the tow, but permit application of finish subsequent to the crimping process.

It is a further aim or aspect of the present invention to improve the quality of this stuffer box crimped tow material by application of the finish subsequent to the crimping.

SUMMARY OF THE INVENTION

The present invention combines a set of crimping rollers which are effective in pulling, dewatering, molding, and forwarding the tow through a stuffer box including two regions, one for crimping and the second for application of finish material. The invention uses a combination of the crimping rollers and the stuffer box containing two regions in a unique manner to crimp and apply finish to the crimped tow.

In the broadest sense, the present invention is directed to an apparatus for crimping a continuous tow of synthetic thermoplastic fibrous materials and application of a finish to the crimped continuous tow comprising a pair of rotatable crimping rollers and a stuffer box chamber having a first region for producing a crimp, and a second region for application of the finish to the crimped continuous tow.

In the broadest sense, the present invention also comprises a crimped textile fibrous tow made by the above apparatus.

DESCRIPTION OF THE PREFERRED EMBODIMENT

Figure 1:
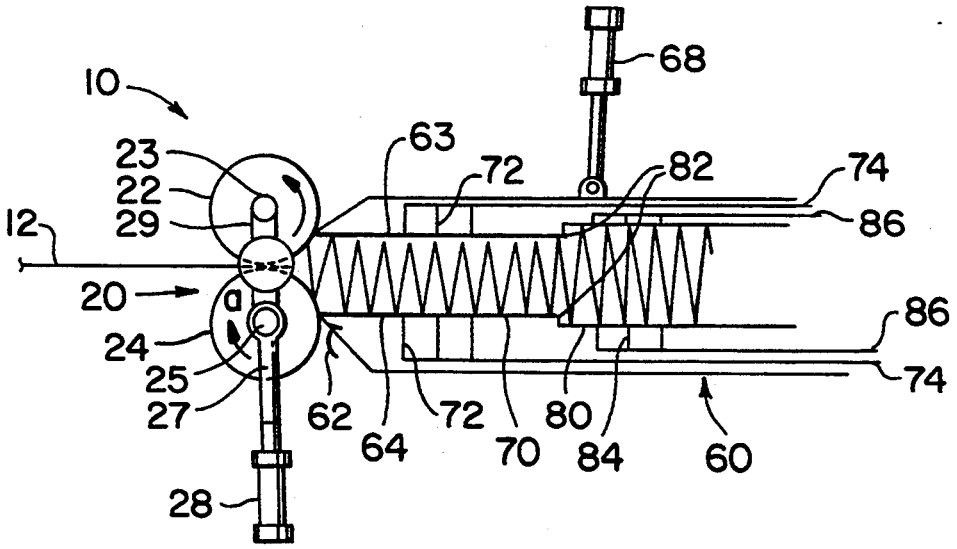
FIG. 1 is a schematic side view of the stuffer box crimping apparatus of the invention illustrating the arrangement of the tow with respect to the rollers and stuffer box.

The principles of the present invention are particularly useful when embodied in a stuffer box crimping apparatus for crimping continuous tow as shown schematically in FIG. 1 and generally indicated by the numeral 10.

The crimping apparatus 10 is generally used to crimp a continuous tow of man-made fiber filaments, referred to herein as tow and designated as 12. Such man-made filaments include nylon and similar textile materials, such as will come readily to the mind of a person skilled in the textile arts. Prominent among suitable textile materials are polyesters (e.g. polyethylene terephthalate), the nylons (polycarbonamides), e.g., 66 nylon (i.e. polyhexamethylene adipamide), also 6-nylon, 11 nylon, 610 nylon, and fiber-forming copolymers thereof, including terpolymers. Other suitable polymeric materials for yarns or strands to be treated according to this invention include most of the thermoplastic fiber-forming materials, such as polyhydrocarbons (e.g. polyethylene, polypropylene), polyacrylonitrile and copolymers of acrylonitrile with other vinyl compounds, also copolymers of vinyl chloride and vinylidene chloride, and polyurethanes. Tow suitable for stuffer box crimping generally has a denier from about 20,000 to about 5,000,000. This list is simply exemplary and is not intended to be exhaustive of suitable compositions, most or all of which are thermoplastic.

According to this invention, thus far considered, the tow is withdrawn from a suitable source of supply, and may be heated by or between successive sets of rolls without sliding contact with a heated oil surface, and is stuffed, while hot, into a stuffer box crimping apparatus within which it is subjected to longitudinal compression to buckle it into crimped configuration. The crimped tow is pushed and then, if the tow is not previously heated, the crimped tow goes through an oven followed by cutting into staple fibers.

The tow filaments enter the stuffing chamber at desired crimping temperature, which is dependent upon the composition, denier, processing rate, time in the chamber, etc., to often is within the range of ambient and 400° F. So long as it is under substantial crimping compression it preferably is kept under adiabatic conditions, or with addition (or subtraction) of heat such as may be required to compensate for heat loss (or frictional heating) and thereby to maintain essentially constant temperature conditions until completion of crimping.

The drawings illustrate the crimping apparatus used for treatment of multifilaments. Although many, if not all, of the suitable compositions are drawable to increased length, usually resulting in orientation of their component macromolecules longitudinally, detailed consideration of drawability of the yarns or strands being treated has been deferred in this application in the interest of orderliness and simplicity of description and illustration.

It has been customary to accomplish such orientation of drawable textile yarns or strands by a drawing process removed or unrelated in location and time (being prior, usually long prior) with respect to whatever crimping process is applied thereto to enhance their bulk, cover, hand, texture, etc. Most crimping processes tend to extend the subject yarn or strand axially while deforming it transversely of the longitudinal axis as in edge crimping, gear-crimping, jet-crimping, and twist-crimping. While there might be reason to believe that it would be feasible to perform such an extensional crimping process soon after drawing, as together with performance of one or more additional steps, the same is not true of a compressive or compressional crimping process, such as stuffer crimping. Reference is made to U.S. Pat. No. 4,004,330 which schematically illustrates and discloses a complete process used to process tow including stuffer-box crimping. It is not intended to limit the use of the present invention to such a process, but to include the description to place the present invention in a frame of reference on how it would be used in the textile industry.

Now referring to the present invention as schematically shown in FIG. 1, the crimping apparatus 10 comprises a pair of rollers 20 for pulling, molding and feeding the incoming tow to an adjacent stuffer box 60. The rollers 20 are rotated by a drive means not shown.

The pair of rollers 20 include a stationary upper roller 22 and a movable lower roller 24. It is understood these rollers could be reversed, i.e. movable upper roller and stationary lower roller. Each of the rollers 22, 24 are solid cylindrical members having smooth cylindrical surfaces (in some case the surfaces could be rough) and end shoulders *22a, 24a,* at each end of cylindrical surfaces to form the intersection of two surfaces perpendicular to each other. Integral with each of the end shoulders *22a, 24a* and projecting outwardly perpendicular to the surface of the end shoulders *22a, 24a* are the shafts 23, 25 that may be regarded as stub shafts.

Generally, each of the rollers 22, 24 have a diameter from about 30 mm to about 250 mm and a length from about 10 mm to about 360 mm. These rollers are generally made of stainless steel or steel and could have a rubber coating over the cylinder surface wherein the surface hardness of the rubber is from about 40 to about 60 shore hardness. These rollers require construction that can withstand forces up to 20 tons resulting from the pressure exerted on the rollers to mold the tow material.

The upper roller 22 is mounted on the crimping apparatus 10 to allow for driven rotation, but stationary as to lateral or vertical movement. To this end, the shafts 23 are mounted in bearings (not shown) fixedly mounted on the crimping apparatus 10. The lower roller 24 is mounted to allow for driven rotation and vertical movement to and from the upper roller 22. To this end, the shafts 25 are mounted on a carriage 27 to allow for the rotation of the roller 24. The lower roller 24 and upper roller 22 are interconnected by a drive belt 29 to drive the upper roller 22. In preferred embodiments, the lower roller 24 and upper roller 22 are driven by a universal gear box including flexible universal joints to allow for changing the spacing between the rollers 22, 24. A hydraulic cylinder 28 is affixed to the carriage 27 to enable the carriage 27 and lower roller 24 to move to and from the upper roller 22 when the hydraulic cylinder 28 is activated.

Figure 2:
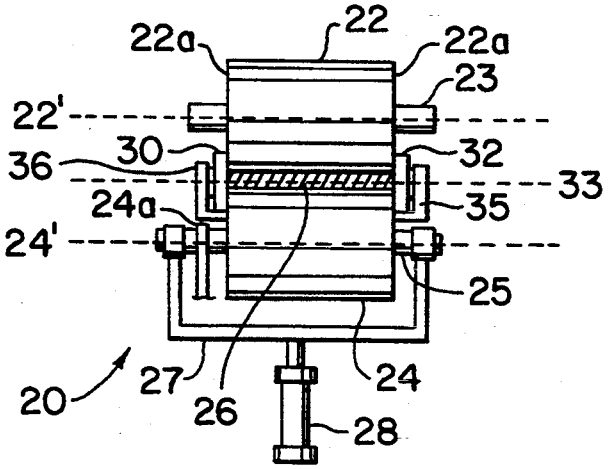
FIG. 2 is a schematic front view of the rollers illustrating the relationship of the rollers, side plates and tow nipped through the rollers.

The lower roller 24 is positioned with respect to the upper roller 22 such that the cylindrical surfaces of the two rollers are radially separated from each other and the cylindrical surfaces are parallel. The distance between the cylindrical surfaces of the two rollers 22, 24 forms part of a rectangular molding nip 26. Forming the ends of the rectangular molding nip 26 are two stationary disk-like side plates 30, 32, one side plate being located at each end of the rollers 22, 24 as shown in FIG. 2. In particular, each of the side plates have flat surfaces that are held in contact with the end shoulders *22a, 24a* of the rollers 22, 24 to define the rectangular molding nip 26. To this end, the side plates 30, 32 have an aligned central axis designated 33 extending parallel to the rotational axis 22', 24' of the respective rollers 22, 24 Each of the side plates 30, 32 are held in position by a suitable holder 35, 36 that maintains the side plates 30, 32 in contact with the rollers 22, 24. To avoid excessive wear of the rollers 22, 24 and the holders 35, 36, each of the side plates 30, 32 is made of a material having a hardness less than that of the rollers. In particular, it is preferred that the side plates be made of brass.

Rotary motion is transferred through the shaft 25 to the lower roller 24 by the drive means not shown but may be an electric motor suitably connected to the shaft 25. The lower roller 24 is rotated at a controlled speed to cause the tow to be pulled through the nip 26. This occurs when the tow is sandwiched between the stationary driven upper roller 22 and the driven lower roller 24. The tow 12 is drawn through a rectangular molding nip 26 defined by the rollers 22, 24 and a pair of rotatable disk-like side plates 30, 32.

With this arrangement, the tow 12 is pulled into the crimping apparatus 10, dewatered, and molded to the configuration of the rectangular molding nip 26. Pressure is exerted on the tow 12 by the action of the lower roller 24 being pressed towards the upper roller 22 wherein the rollers are rotating as indicated by arrow a in FIG. 1. The amount of pressure exerted may be from 1/10 ton to 20 tons. As the tow passes through the molding nip 26, it is pressed out against the side plates 30, 32 rubbing thereagainst. The resulting molded tow has the desired rectangular configuration corresponding to that of the molding nip 26.

The molded tow is then fed into the stuffer box 60 by the rollers 20 and pressed strongly during its advance against the inner walls of the inner surfaces of the upper and lower plates 63, 64, as well as the side plates defining the stuffer box chamber and the motion is opposed by the upper plate 63. The upper plate 63 may be moved up or down by the hydraulic cylinder 68. The velocity of the tow material is reduced in accordance with further advance so that the area of contact between the filaments and inner walls comes to increase. This action results in the crimp of the tow.

More specifically, the stuffer box 60 contains two regions, a first region 70 adjacent the pair of rollers and a second region 80 for application of a finish.

In particular, the first region 70 of the stuffer box 60 is a conventional crimper stuffer box design. Included in the first region 70 are a plurality of steam injection ports 72, located to cause substantially uniform distribution of the steam to the tow to set the crimp in the tow. As shown in FIG. 1, the steam injection ports 72 are on the inner surfaces of the lower plate 64 and upper plate 63, each being connected to a steam supply (not shown) through suitable piping 74 extending through the respective plate 63, 64.

The steam pressure employed in the first region 70 in the crimping operation of the invention is an important operating variable. We have found that said steam pressure should be at least about 3 psig (pounds per square inch gauge) e.g. about 5 to about 35 psig, in order to obtain a significant increase in crimp recovery over that obtained in the absence of steam. The actual steam pressure employed will depend upon factors such as the type and denier of fiber and the total denier of the tow or yarn being processed. Higher steam pressure can be used with higher denier fibers. Excessive steam pressures can disrupt the orderly advance of the fibers through the crimping zone, e.g., by physically blowing the fibers out of the crimper. Thus, to some extent at least, the upper limit on the steam pressure used will be determined by the design of the particular crimper apparatus employed. Thus, for small denier fibers, e.g. up to 18 dpf, the steam pressure in said region of relatively high steam pressure will be in the range of from at least 3 psig up to about 15 psig. The cross section of the fiber being processed also has an effect on the permissible higher steam pressures. It will be understood that the steam pressure used will be such that the temperature of the steam is sufficient to increase the temperature of the fibers sufficient to soften same and to obtain good crimping, but insufficient to melt said fibers, taking into consideration the residence time of the fibers in the crimper.

The residence time of the fibers in the crimper is not critical so long as it is sufficient to permit the fibers to soften for crimping, but insufficient to cause melting or fusing of the fibers at the highest temperature existing in the crimper. The residence time will vary with the type and denier of the fiber being processed, and also with the mechanical design of the crimper. Thus, in general, no specific numerical upper limits can be set for the residence time of the fibers in the crimper. Generally speaking, and as a guide to those skilled in the art, the total residence time of the fiber in a commercial size crimper similar to those illustrated in the drawings (with a compaction chamber having a width of about 4 inches) can be in the order of from about 4 to about 5.5 seconds. One general rule of thumb which can be followed is that the residence time in said high pressure region should be from about 0.1 to about 0.35 times the total residence time in the crimper.

Maintaining the steam pressure in the region of relatively high steam pressure substantially constant is definitely preferred and is an important operating condition. When using steam a constant pressure equals a constant temperature. These constant operating conditions result in a markedly more uniform product. We have found that the crimp level, and the crimp recovery, fluctuate much more widely when the steam pressure in the region of relatively high steam pressure in the crimper varies. Steam fills the voids in the mass of crimped fibers. If said voids are filled with steam under essentially constant pressure conditions, this promotes product uniformity. Furthermore, as essentially constant steam pressure in said region of relatively high steam pressure promotes uniformity of conditions in the region of low but increasing steam pressure which is upstream of said region of relatively high steam pressure, because the increase in pressure in said region of low but increasing steam pressure will be more uniform. Similarly, uniformity of conditions in the region of decreasing steam pressure is also obtained because the decrease in pressure therein will be more uniform. This can be shown by running pressure profiles across the three regions present in the crimping zone.

After the tow has been crimped and the crimp heat set by steam in the first region 70, the tow moves into the second region 80 where the tow expands into a larger cross sectional area and finish is sprayed onto the tow. In the present embodiment, the second region 80 is an extension added onto a commercial stuffer box. In particular the top plate 63 and the side plates are extended by bolt on extensions while the lower plate 64 is extended by attachment of the extension to increase the distance between the inner surfaces of the lower and upper plate by 1 mm. As shown in FIG. 1, the second region 80 starts at the step 82 between the first and second regions.

The purpose of the step or increased cross sectional area of the second region, is to provide area for the crimped tow to expand. This may be accomplished by increasing the cross sectional area by increasing the distance of at least the inner surfaces of the top and bottom plates 63, 64 and optionally, the distance between the inner surfaces of the sidewalls. The increased cross sectional area will be determined by the resulting uniform application of the finish to the tow.

The finish is applied to the expanded tow through the finish injection ports 84 supplied from a finish supply through suitable piping 86 which extend through the lower plate 64.

As with the steam pressure, the pressure employed in the second region 80 in applying the finish to the tow is an important operating variable. We have found that said finish pressure should be at least 5 psig in order to obtain uniform application of the finish to the crimped tow and up to 100 psig. The actual finish pressure employed will depend upon factors such as type and denier of fiber and the total denier of the crimped tow being processed.

Thus, it is apparent that there has been provided in accordance with the invention, a crimping apparatus including a pair of rollers and a stuffer box with the two regions that fully satisfies the objects, aims and advantages as set forth above. While the invention has been described in conjunction with the specific embodiments thereof and in the examples, it is evident that many alternatives, modifications and variations will be apparent to those skilled in the art, in light of the foregoing description. Accordingly, it is intended to embrace all such alternatives, modifications and variations that fall within the sphere and scope of the invention. It is not intended for the invention to be limited by the theory offered by the applicants, but only for the matter of clarification or explanation of the invention.

It is claimed:

1. An apparatus for crimping a continuous tow of synthetic thermoplastic fibrous materials and application of a finish to the crimped continuous tow comprising a) a pair of rotatable rollers having cylindrical surfaces, which surfaces are radially separated from each other and parallel to each other, and a pair of side plates, one at each end of said pair of rollers, said rollers and said side plates being combined to define a nip and exert pressure on said continuous tow passing through said nip to mold said tow and forward it through a stuffer box; and b) a stuffer box chamber having a first region for producing and setting a crimp in said continuous tow, said first region located adjacent said pair of rollers and immediately downstream therefrom in the direction of the passage of said tow and a second region for application of a finish to crimped continuous tow, said second region located adjacent said first region and immediately downstream therefrom in the direction of the passage of said tow and having a larger cross sectional area than the first region perpendicular to the direction of passage of said tow to allow crimped tow to expand.

2. An apparatus of claim 1 wherein said first region of said stuffer box chamber has injection ports connected to steam supply means for introducing steam into said first region and said second region has injection ports connected to finish supply means for introducing finish to said second region.

3. A method of crimping a tow of continuous filaments and subsequently applying a finish thereto comprising the steps of a) passing said tow of continuous filaments through a means to mold said tow, said means having a defined space through which said tow passes and wherein said tow is molded to a configuration of said defined space;

b) continuously feeding the molded tow into a stuffer box having a first region wherein the tow is maintained for a time sufficient to impart a crimp therein, and a second region having a larger cross-sectional area than the first region perpendicular to the direction of passage of said tow and into which the crimped tow expands and wherein a finish is applied to the expanded crimped tow; and c) removing the crimped tow from said stuffer box.

4. A method of claim 3 wherein steam is applied onto the tow in the first region.

5. A method of crimping synthetic thermoplastic fibers having a drawn denier from about 0.5 to about 80 dpf, to produce crimped fibers coated with a finish, which method comprises crimping said fibers by passing a continuous tow of said fibers under crimping conditions through a crimping zone defined as a first region, moving the crimped tow of thermoplastic fibers into a second region which is located adjacent to said first region and immediately downstream therefrom in the direction of the passage of said tow and which has a larger cross-sectional area than the first region perpendicular to the direction of passage of the tow and allowing said crimped tow to expand into the second region and applying a finish to the expanded crimped continuous tow in the second region.

6. An apparatus according to claim 1 wherein the first and second-regions of the stuffer box chamber are horizontally adjacent to one another and are each defined by an upper plate and a lower plate and side plates and the second region starts at a step between said first and second regions which results from there being an increased distance between the upper and lower plates of the second region.

7. An apparatus according to claim 6 wherein the upper plate is capable of being moved up or down.

8. An apparatus according to claim 1 wherein the stuffer box chamber is defined by an upper plate and a lower plate and side plates and the upper plate is capable of being moved up or down.

9. An apparatus according to claim 2 wherein the stuffer box chamber is defined by an upper plate and a lower plate and side plates and the upper plate is capable of being moved up or down.

10. A method according to claim 3 wherein the finish is applied to the crimped tow under a pressure of at least 5 psig.

11. A method according to claim 10 wherein the cross-sectional area of the second region is large enough that the crimped tow expands sufficiently so that uniform application of the finish to the tow is effected.

12. A method according to claim 11 wherein the means to mold the tow comprises a pair of parallel rollers which pull the tow through a nip defined by said rollers and feed the molded tow into the stuffer box where the tow is crimped as a result of being pressed against the inner walls of upper and lower plates and side plates which define the first region of the stuffer box.

13. A method according to claim 12 wherein the direction of passage of the tow is horizontal.

14. A method according to claim 11 wherein the direction of passage of the tow is horizontal.

15. A method according to claim 10 wherein the means to mold the tow comprises a pair of parallel rollers which pull the tow through a nip defined by said rollers and feed the molded tow into the stuffer box where the tow is crimped as a result of being pressed against the inner walls of upper and lower plates and side plates which define the first region of the stuffer box.

16. A method according to claim 3 wherein the means to mold the tow comprises a pair of parallel rollers which pull the tow through a nip defined by said rollers and feed the molded tow into the stuffer box where the tow is crimped as a result of being pressed against the inner walls of upper and lower plates and side plates which define the first region of the stuffer box.

17. A method according to claim 3 wherein the direction of passage of the tow is horizontal.

* * * * *